United States Patent [19]

Nelson

[11] 4,343,146

[45] Aug. 10, 1982

[54] BULKED CONTINUOUS FILAMENT YARN WITH COLOR-POINT HEATHER

[75] Inventor: Thomas L. Nelson, Georgetown, Del.

[73] Assignee: E. I. Du Pont de Nemours and Company, Wilmington, Del.

[21] Appl. No.: 192,033

[22] Filed: Sep. 29, 1980

Related U.S. Application Data

[63] Continuation-in-part of Ser. No. 135,126, Mar. 28, 1980, abandoned.

[51] Int. Cl.[3] ..... D02G 3/34

[52] U.S. Cl. ..... 57/208; 57/350; 57/908; 28/271

[58] Field of Search ..... 57/6, 13, 24, 289, 333, 57/350, 908; 28/271

[56] References Cited

U.S. PATENT DOCUMENTS

| | | | |
|---|---|---|---|
| 3,110,151 | 11/1963 | Bunting et al. . | |
| 3,474,613 | 10/1969 | Joarder et al. | 57/208 |
| 3,781,949 | 1/1974 | Breen et al. . | |
| 3,953,962 | 5/1976 | Breen et al. . | |
| 4,058,968 | 11/1977 | Benson | 57/208 X |
| 4,059,873 | 11/1977 | Nelson . | |
| 4,064,686 | 12/1977 | Whitted | 57/205 X |
| 4,145,869 | 3/1979 | Duncan et al. | 57/208 X |
| 4,222,223 | 9/1980 | Nelson | 57/908 X |
| 4,248,036 | 2/1981 | Barron | 57/908 X |
| 4,280,261 | 7/1981 | Nelson | 57/908 X |

*Primary Examiner*—Donald Watkins

[57] ABSTRACT

A novel synthetic heather yarn is comprised of a first yarn in the form a relatively loose matrix of crimped filaments which are randomly intermingled with portions of a bulked differentially-colored or colorable second yarn which contains frequent periodic color-point nodes of high filament entanglement and which nodes are free from filament intermingling with said first yarn. The combined yarn is made using fluid-jets first to make the nodes in the color-print yarn or yarns and then to combine the color-point with the matrix yarn in a subsequent filament intermingling zone.

14 Claims, 2 Drawing Figures

BULKED CONTINUOUS FILAMENT YARN WITH COLOR-POINT HEATHER

CROSS-REFERENCE TO RELATED APPLICATION

This application is a continuation-in-part of my copending application Ser. No. 135,126 filed Mar. 28, 1980, now abandoned.

DESCRIPTION

1. Technical Field

This invention concerns a synthetic bulked continuous filament (BCF) yarn which has been or can be differentially dyed to produce a novel heather appearance. The heather appearance includes enhanced small distinct points of individual color, i.e., color-points, randomly distributed along and throughout a matrix of contrasting color or colors. The invention includes not only dyeable and dyed yarns but also articles prepared therefrom and a process for making such yarns by intermingling a first BCF yarn component which is substantially free from filament entanglement with a second BCF yarn component which has periodic regions of high filament entanglement which persist in the combined yarn.

2. Background Art

Heather BCF yarns can be made from differentially dyeable or dyed BCF component yarns in various ways to provide a variety of heather appearances which can range in yarns from a very bold heather with relatively long random lengths of individual color (obtainable with a limited amount of yarn-to-yarn filament intermingling between components) to a very fine heather (with a high degree of yarn-to-yarn filament intermingling between components).

U.S. Pat. No. 4,059,873 (Nelson) refers to such various known methods and also discloses a process for making a BCF heather yarn having mixed degrees of heather which includes not only the colors of the component yarns but also includes "various blends of such colors, with the areas of these different colors being randomly interspersed along the heather yarn whereby a pile fabric prepared therefrom has the appearance of individual color 'points', which are the component yarn colors, dispersed in a heathered background which mutes the color 'points' and consists of various colors arising from various degrees of blending of the component yarns making up the heather yarn." In such a heather yarn the filaments of the components are "yarn-to-yarn randomly intermingled to form yarn-to-yarn blended areas of random length of said filaments randomly interspersed between yarn-to-yarn unblended areas of random length." The blended areas hold the component yarns together to form the heather yarns. Such yarns can be made into pile fabrics which are substantially free of noticeable streaks and chevrons and which are characterized by individual colors of the component yarns being visible but yet muted in appearance. To achieve this result, all of the component yarns must be substantially free of filament entanglement upon being fed into the intermingling process. Bolder heather effects with larger areas of individual color can be obtained using a similar process but with component yarns having filament entanglement normal for commercial BCF yarn which entanglement limits yarn-to-yarn filament intermingling when they are combined.

Due to the high popularity of BCF heather yarns in the tufted carpet market, carpet stylists continue to look for yarns providing distinctive, novel heather effects; however, the preparation of acceptable new yarns remains quite difficult due to the necessity of combining the component yarns in a sufficiently random yet consistent manner to obtain a distinctive and desirable mixed yarn which is not subject to the formation of objectionable directionality or patterning, such as streaks and chevrons, in the finished article.

DISCLOSURE OF THE INVENTION

Figure 1:
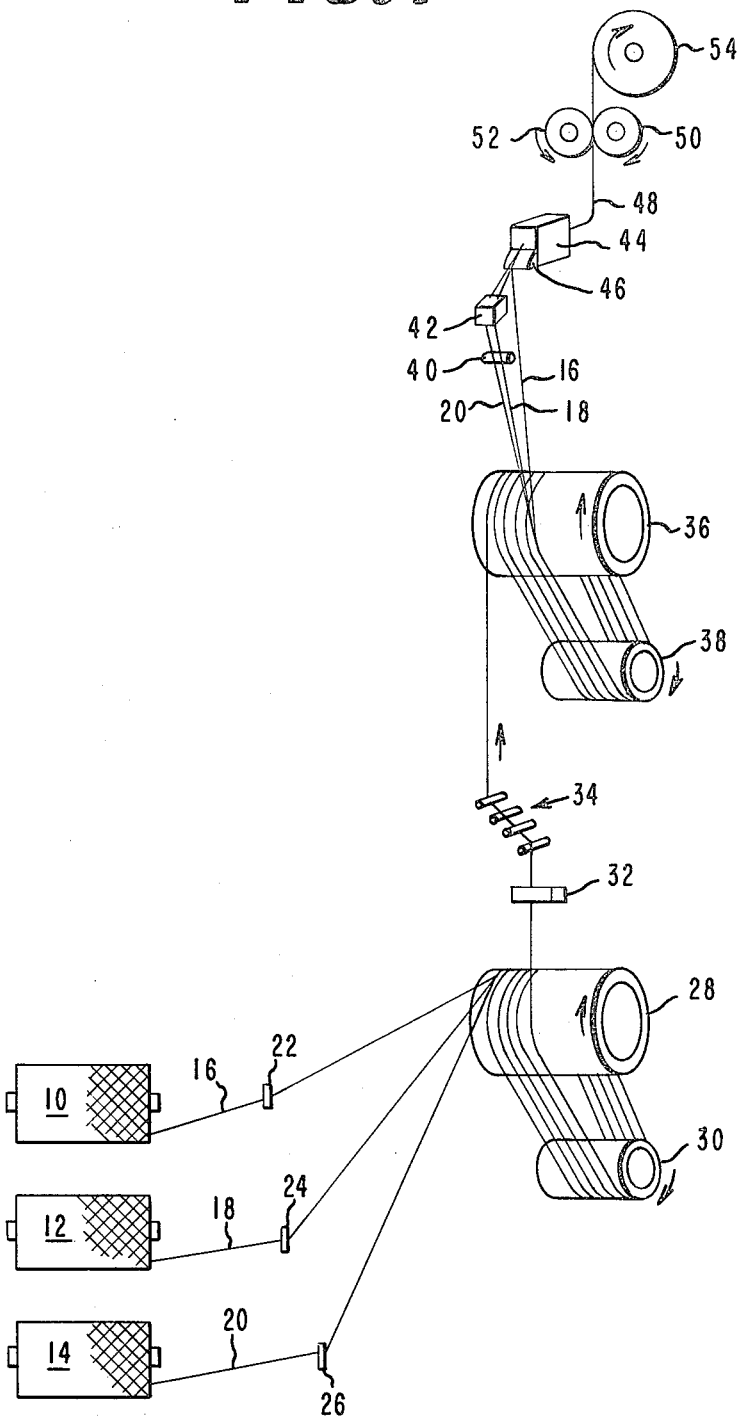
FIG. 1 is a schematic elevational representation of an apparatus performing a process of this invention.

The product of this invention is a heather-dyeable or heather-dyed synthetic combined yarn comprised of a first yarn in the form of a relatively loose matrix of crimped filaments which are randomly intermingled with portions of at least one second yarn which is differentially-dyeable or differentially-dyed with respect to said first yarn and which contains frequent periodic short relatively compact nodal regions of high filament entanglement across the entire filament bundle of the second yarn which nodal regions are substantially free from intermingling with filaments of said first yarn, said nodal regions being separated along the length of the second yarn by bulkier, relatively open regions of the same crimped filaments randomly intermingled with filaments of said first yarn to provide a coherent combined yarn.

Additional distinctive effects in appearance and styling can be obtained when the filaments in the combined yarn of either the first or second yarn are longer than the filaments of the other of said yarns. For example, if the longer filaments are in the color-point second yarn component, the extra length is consumed by buckled sections and loops randomly distributed along the surface of the combined yarn. The loops can be either crunodal or arched, depending upon the length differential and the intermingling conditions. If the longer filaments are in the matrix first yarn, the extra length accumulates in surface loops of filaments of the matrix yarn, as described for example in U.S. Pat. No. 4,222,223 (Nelson). Particularly distinctive and useful products are obtained when the filaments of the one yarn are longer than the filaments of the other yarn within the range of 15 to 45%, and preferably 20 to 30%.

This invention also includes an improved process for making a heather-dyeable or heather-dyed yarn by feeding a plurality of substantially twist-free, differentially-dyeable or differentially-dyed, bulked continuous-filament yarns under forwarding tension and in a contiguous relationship into a jet intermingling zone, randomly jet intermingling the filaments of said yarns from yarn to yarn and withdrawing a coherent combined yarn from said zone at a rate which is 4 to 30% less than the feed rates of the component yarns into said zone, one yarn of said plurality being a first yarn which is substantially free of filament entanglement, wherein the improvement comprises feeding as another yarn of said plurality a second yarn which is differentially-dyeable or differentially-dyed with respect to said first yarn and which has periodic filament entanglement consisting essentially of frequent short relatively compact nodal regions of high entanglement across its entire filament bundle separated along the second yarn by bulkier regions of filaments relatively free of entanglement, preferably with the average distance between said compact nodal regions being in the range of from about 0.5 to 4.0 inches (1.27 to 10.16 cm.).

When the feed rates of said first and second yarns are not equal, overfeed for the faster of the two can be up to 45% higher than that for the slower of the two. To provide the desired amount of filament intermingling between the yarns in the process of this invention, the combined yarn must be withdrawn from the intermingling zone at a rate which is 4 to 30% less than the feed rates of the yarns into said zone. However, as long as the slower (or slowest as the case may be) of the yarn components is overfed within this range of 4 to 30%, other components may be overfed at the higher rate, particularly from 15 to 45% higher, and preferably 20 to 30% higher. This differential overfeed of course results in a combined yarn having a corresponding difference in filament lengths of the component yarns.

As used herein, percent overfeed in the intermingling zone is calculated as the difference between feed roll speed minus the withdrawing roll speed, i.e., surface speeds, divided by the withdrawing roll speed and multiplied by 100. Differences in percent overfeed are calculated by subtracting the lower from the higher overfeed.

The periodic filament entanglement called for in the color-point second yarns of this invention provides the novel and distinctive heather appearance of this invention along with adequate coherency in the combined yarn and freedom from directionality in colored textile articles made therefrom. The period entanglement (entanglement is commonly called "interlacing" in compact nonbulked yarns) and methods for its production are described by Bunting and Nelson in U.S. Pat. No. 3,110,151 at column 9, line 57 through column 10, line 38. The tension on the bulked, entanglement-free yarn while being subjected to the periodic entangling process is preferably less than 0.1 grams per denier. In the case of the coupled entangling and intermingling process as illustrated in FIG. 1 herein, the tension on the yarn during periodic entangling is primarily the result of the pulling force of a second jet device, due to its forwarding action caused by the gate which partially blocks the entrance to the yarn passageway.

Jet bulked BCF yarn normally has a certain degree of cohesion due to intermingling of the filaments, but this intermingling is usually only among part of the filaments at any location along the yarn, seldomly among all filaments at a given location. Therefore, if two or more yarns of different dyeability are treated according to the Nelson U.S. Pat. No. 4,059,873 even without removing the cohesion, the filament bundles can open to a certain extent so that filaments of the different types can blend, but the majority of the yarn will appear as individual colors (bold heather). When the cohesion is removed by tensioning the component yarns before jet treatment, the filaments are able to open and blend more frequently, thus there will be fewer zones of solid color and more blended zones. For example, a yellow and a blue yarn combined will have some zones of yellow or blue but will also have blended zones showing various shades of green. In U.S. Pat. No. 4,059,873 the points of individual color or "flashes" are described as having an average length of 3.9 to 16.5 centimeters.

In making yarns of the present invention, the color point ends first have any cohesion removed by tensioning then they are interlaced individually to give whole-bundle cohesive nodes repeating at intervals at about 0.5 to 4.0 inches (1.3–10.2 cm.) from center-to-center, and more preferably 0.5 to 2.5 inches (1.3–6.4 cm.). At a given yarn speed the nodal frequency can be controlled by the fluid pressure supplying the entangling jet; increasing the pressure increases the nodal frequency which decreases the distance between nodes. Nodal spacings (overall average distance determined by pull-apart test) greater than 2.5 inches (6.4 cm.) tend to allow excessive blending between the matrix and color-point yarns and can result in excessively long persistence of a given color along the yarn which can lead to streakiness and directionality, for example in pile fabrics. At spacings less than about 2.5 inch (6.4 cm.) average nodal distance, the color points become more obvious and distinct in fabrics as the average distance decreases. No blending subsequently takes place at these nodes since they do not allow the filaments to open up during subsequent jet processing. Between nodes, however, there are short regions which can open sufficiently to allow a degree of intermingling with filaments of the noncohesive matrix first yarn sufficient to provide mechanical cohesion between the yarns but not sufficient to show much blending of colors. During jet processing, the matrix yarn may divide and entangle completely around the color point end or ends, which in some cases give the appearance of the yarns being false twisted about each other and in other cases as actually false twisted for sections of about 1 centimeter or less.

Thus in a yarn of the present invention consisting of a blue color point end and a yellow matrix, blue will be seen most clearly, the yellow will be distributed along and around the blue, and there will be a minority of zones of short length appearing green.

Differences between yarns of the present invention and U.S. Pat. No. 4,059,873 can be seen most clearly when they are tufted into loop pile carpets. Blended yarns of the patent will show more regions of blended colors than of the individual colors, and the individual colors more frequently carry over to adjacent loops because of the greater persistence of one color along the length of the yarn; thus there are larger areas of loops of like color in these carpets. On the other hand, two-color yarns of the present invention in loop pile carpets tend to show one color or the other or both colors at the top of each loop but show few blended color zones. The persistence of one color along the length of the yarn frequently is less than the length of yarn constituting each pile loop and therefore the colors appear differently in each adjacent loop. Furthermore, the diameter of a color-point yarn end varies from loop to loop, being constricted when a node is at the top of a loop, giving more intense color clarity in the constricted region. Yarns of more than two colors behave similarly.

This invention extends the styling versatility of heather BCF yarns by a novel combination of fluid jet yarn treating processes. A novel effect is obtained by combining and intermingling at least one yarn component which frequently contains periodic entanglement across the entire yarn bundle which at least one component which is substantially free of filament entanglement. In the combined yarn product the yarn with periodic entanglement maintains its integrity and tends to follow a somewhat sinuous path through and along the less entangled filaments of the matrix yarn. To achieve this result, the BCF matrix yarn must be substantially free of (or freed of) filament entanglement. This can be accomplished by using yarns bulked in a manner which results in little if any entanglement in the bulked yarn, such as by hot gear crimping, or by removing filament entanglement from a bulked yarn, as a hot fluid jet bulked yarn, by applying tension to the yarn and pulling it under tension in an interwoven path through a series of parallel snubbing pins in the manner described for example in U.S. Pat. No. 4,059,873 as shown in FIG. 1 therein and discussed at column 4, lines 34–46 and column 6, lines 21–35.

The second yarn which is to be the color-point yarn must be separately treated to introduce the desired level of periodic entanglement, preferably with a transverse impingement entangling, jet with a single impinging fluid stream in the yarn passageway. The same jet type can be used for the subsequent intermingling of the components with one another. The disentangling and periodic entangling steps may be performed as separate steps with rewinding of the yarn in between steps, or performed in a coupled continuous manner as shown for example in FIG. 1 herein.

Conventional BCF carpet yarns can be used as the component feed yarns. Particularly preferred for their styling and performance are combinations of such feed yarns of polyamides, particularly 66-nylon, having cationic, light acid and deep acid dyeabilities with each component having a denier within the range of from 500 to about 1250.

FIG. 1 illustrates a preferred coupled process of the invention. It shows three BCF yarn packages 10, 12, 14 held in a fixed position on a creel (not shown) from which are withdrawn respectively three polyamide feed yarns 16, 18, 20.

The dyeabilities of these three yarns are light acid, deep acid and cationic, respectively. The yarns pass through guides 22, 24, 26 on their way to driven snubbing roll 28 and its associated separator roll 30 around which they pass in a side-by-side relationship in sufficient multiple wraps to avoid slippage. The yarns next pass through a water applicator 32 wherein water is continuously applied to the yarns to facilitate subsequent intermingling as known in the art. The water can be applied in various ways and at various locations before the jet treatment; i.e., the location prior to the jet is not critical. The side-by-side yarns next pass through snubbing device 34 which consists of a series of parallel cylindrical snubbing pins with the yarn passing over and under alternate pins to create frictional tension on the yarns and to spread out the filaments in each yarn to facilitate straightening of the filaments and their disentanglement. The yarns then proceed to driven feed roll 36 and its separator roll 38. Rolls 36, 38 have a surface speed slightly faster than snubbing rolls 28, 30 to subject the yarns to additional tension for straightening and disentangling the filaments but not sufficient to cause drawing of the filaments which would be detrimental to yarn bulk by permanently reducing filament crimp. After making multiple wraps around rolls 36, 38 to prevent slippage the yarns are separated from one another, with first yarn 16 passing directly to fluid intermingling jet assembly 44 over entrance gate 46 while color-point second yarns 18, 20 aided by splitter pin 40 pass through separate yarn passages in fluid jet entangling assembly 42. Jet assembly 42 introduces the desired periodic entanglement into second yarns 18, 20 which will form the color-points in the dyed product. Yarns 18 and 20 then rejoin yarn 16 in a contiguous relationship at gate 46 before entering jet assembly 44 together. The yarns pass through jet assembly 44 in an overfeed condition whereupon they become intermingled into a coherent color-point heather-dyeable yarn of the invention 48. Yarn 48 is removed from the exiting fluid stream from jet assembly 44 at an angle of about 90° by coner rolls 50, 52 in a conventional manner. To provide overfeed, the surface speed of rolls 50, 52 is less than that of rolls 36, 38 by the amount needed to provide the desired overfeed through jet assembly 44. Coner rolls 50, 52 then forward yarn 48 to a winding device (not shown) for winding the yarn into a heather yarn package 54.

Figure 2:
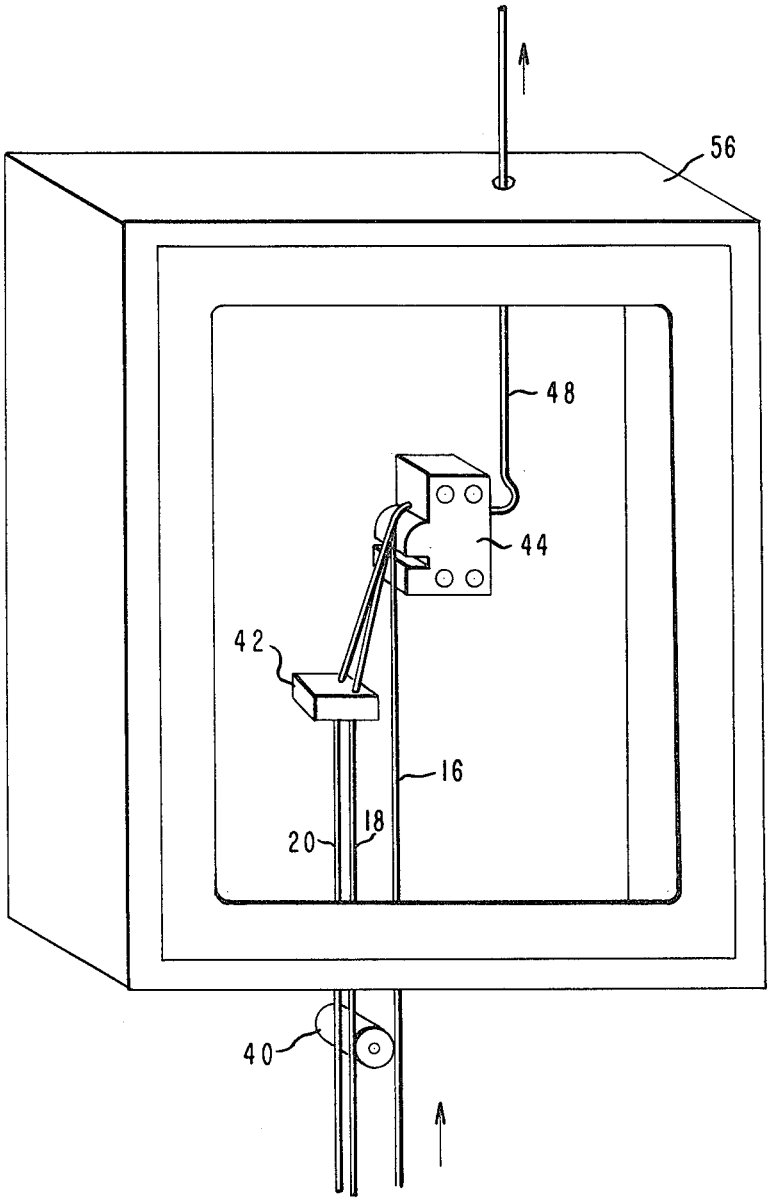
FIG. 2 is an enlarged simplified perspective view of jet entangling and intermingling devices in a sound-deadening enclosure in use as in FIG. 1.

Entangling jet assembly 42 and intermingling jet assembly 44 each has a single cylindrical yarn passageway with a single fluid passage impinging perpendicularly onto the yarn path through the assembly, for example of the type shown and described with relation to FIG. 2 in U.S. Pat. No. 4,059,873. The entrance to the yarn passageway is restricted (e.g. by 10 to 60% of the opening) by gate 46 which reduces twisting action of the jet and causes the intermingling fluid primarily to exit the yarn passageway through the opposite end of the assembly as well as to control the path of the yarns through the yarn passageway.

FIG. 2 shows an isolated view of entangling jet assembly 42 and intermingling jet assembly 44 of FIG. 1 surrounded by a sound-deadening enclosure 56. As in FIG. 1, splitter pin 40 guides color-point component yarns 18, 20 through entangling jet assembly 42 before rejoining matrix component yarn 16 at the entrance to intermingling jet assembly 44.

The term "bulked" as used herein refers to yarns of permanently crimped filaments, that is the filaments retain their crimp upon removal from the yarn.

The first and second yarns of this invention may be colored differentially at any stage of processing, for example before or after being combined and even after the combined yarn has been made into a textile article such as upholstery fabric or a carpet. Although "differentially-dyeable or dyed" yarns have been referred to most frequently and are preferred because of their more common usage and availability, yarns colored or colorable by other means than by dyeing, such as by containing pigments, are comprehended and can provide equivalent results.

In general, throughout this invention "dyeable" and "dyed" yarns can be used interchangeably without materially affecting the result with respect to the invention.

The first and second yarn components of the combined yarn of this invention can each be comprised of a single yarn or of a plurality of light denier yarns which have been doubled without twist to obtain a heavier denier yarn, provided the doubled yarn otherwise meets the requirements called for. More than one first matrix yarn and more than one color-point second yarn can be used. Two-color and three-color heather yarns are of particular interest in carpets.

Test Methods

The Coherency Factor measure of filament entanglement in a yarn is determined by clamping a sample of yarn in a vertical position under the tension provided by a weight in grams which is 0.20×the yarn denier (but not greater than 100 grams). A weighted hook, having a total weight in grams numerically equal to the average denier per filament of the yarn (but weighing not more than 10 grams), is inserted through the yarn bundle and lowered at a rate of 1 to 2 centimeters per second until the weight of the hook is supported by the yarn. The distance which the hook has travelled through the yarn until the weight is supported characterizes the extent of filament entanglement in the yarn. The result is expressed as a "Coherency Factor" which is defined as 100 divided by the above travelled distance in centimeters. Since filament intermingling is random a sufficiently large number of samples should be tested to define a representative average value for the whole yarn.

The Lateral Pull-Apart Test directly measures the lateral bundle cohesiveness of a yarn. Two hooks are placed at a randomly selected point in about the center of the yarn bundle to separate it into two groups of filaments. The hooks are pulled apart at a rate of 5 inches/min. (12.7 cm./min.) at a 90° angle to the yarn axis by a tensile testing machine which measures the resistance to separation, such as an "Instron" machine. The yarn is pulled apart by the hooks until a one-pound (454 gm.) force is exerted, at which point the machine is stopped and the distance between the two hooks is measured and recorded. Ten determinations are made and the average taken as the pull-apart value. The test yarn lengths should be at least 4–6 inches (10–15 cm.) long and selected randomly throughout a yarn package.

The Lateral Pull-Apart Test is used to determine the spacing of nodal entanglement in the color-point component yarn either before or after being combined to form a heather yarn of this invention. In the latter event, samples of the component to be tested are carefully teased out of the combined yarn bundle after the yarn has been dyed so that the component can be easily identified. Tools such as an illuminated magnifying glass, a yarn pick, and tweezers may be used to facilitate disentangling the color-point end from the sample for testing as above. Several attempts may be necessary to obtain satisfactory specimens. Sufficient samples are tested to provide 5 averages of 10 specimens each. The 5 averages are then used to calculate an overall average of separation distance for the yarn component being tested.

EXAMPLE I

This example is of a three component heather yarn of the invention with two equal denier color-point yarns and a larger denier matrix yarn. All three of the component yarns as initially obtained are conventional commercial BCF yarns of 66-nylon which have been bulked by a hot fluid jet screen-bulking process of the type described in U.S. Pat. No. 3,781,949. The two color-point yarns each have a yarn denier of 760 and contain 40 filaments of substantially equal denier per filament; one is cationically dyeable (Du Pont Type 854) and the other is a low amine end light acid dyeable yarn (Du Pont Type 855). The matrix yarn component has a denier of 1245, contains 80 high amine end deep acid-dyeable filaments of about 15 denier per filament and three antistatic filaments which total about 20 denier (Du Pont Type 857). Each of the three components as manufactured contains a random amount of subgroup filament entanglement, due to the nature of the bulking process, which is sufficient to permit commercial handling and processing and corresponds to a coherency factor of greater than about 25. The yarns are treated to remove this initial entanglement, to insert nodal entanglement in each of the color-point yarns individually and then to combine them in a continuous process of the invention as represented in FIGS. 1 and 2. The feed roll surface speed is 1072 ypm (984 meters per minute) and the coner roll speed is 1030 ypm (944 meters per minute) for an overfeed of 4.0% at intermingling jet assembly 44. Between the snub rolls and the feed roll, the yarns are subjected to a tension of 1.2 grams per denier and four parallel snub pins are used to facilitiate filament disentanglement. The color-point entangling jets are each supplied with air at 150/9 psig/scfm (10.54 kg./cm$^2$//0.255 cu.m./min.) and the intermingling jet with air at 150/31 psig/scfm (10.54 kg./cm$^2$//0.878 cu.m./min.). Water is applied to the yarns at a rate of 1.2 gallons per hour (4.55 l./hr.). The heather-dyeable yarn product is wound under a tension of 170 grams.

Each entangling jet device for the two color-point yarn ends consists of a cylindrical yarn passageway 0.086 inch (0.218 cm.) in diameter and 0.75 inch (1.905 cm.) long. The two passageways are located side-by-side and parallel to one another in a common metal housing. Each yarn passageway is perpendicularly intersected by a cylindrical fluid passageway 0.062 inch (0.157 cm.) in diameter. The center line of the fluid passageway intersects the yarn passageway at a point 0.250 inch (0.635 cm.) from the entrance end of the yarn passageway and thus 0.500 inch (1.27 cm.) from its exit end. The center lines of the two passageways intersect within 0.001 inch (0.0254 mm.) of one another. Each yarn enters its respective yarn passageway over the smoothly rounded surface of a straight-edged metal gate which blocks 17% of the yarn passageway entrance and is of the type shown in FIG. 2 of U.S. Pat. No. 4,059,873. The edge of the gate which partially blocks the entrance is perpendicular to the axis of the fluid passageway and covers a portion of the passageway on the same side from which the fluid enters the yarn passageway.

The intermingling jet device for combining the matrix and color-point yarns has a cylindrical yarn passageway 0.159 inch (0.404 cm.) in diameter and 0.75 inch (1.905 cm.) long. The yarn passageway is perpendicularly intersected by a cylindrical fluid passageway 0.125 inch (0.318 cm.) in diameter with the center line of the fluid passageway being 0.250 inch (0.635 cm.) from the yarn entrance end of the yarn passageway. The center line of the fluid passageway is offset by 0.004 inch (0.101 mm.) from the center line of the yarn passageway so that the two do not quite intersect. A yarn gate as above blocks 55% of the entrance to the yarn passageway. In this case the edge of the gate over which the yarns pass is parallel to the axis of the fluid passageway and the offset of the center line of the fluid passageway is in a direction towards the open part of the passageway above the gate.

The two color-point yarns are found to have frequent periodic short relatively compact nodal regions of high filament entanglement separated along each yarn by bulkier more open filament regions. The spacing of the nodes provides values in the Pull-Apart Test of 0.90 inch (2.29 cm.) and 0.94 inch (2.39 cm.) for the cationic and light acid dyeable yarns respectively. Prior to entering the intermingling zone, and after disentangling, the matrix yarn has a coherency factor of less than 5.

In the combined yarn the nodal regions of the two color-point yarns are substantially free from filament intermingling with the matrix yarn whereas the bulkier more open regions of the color-point yarns contain some random filament intermingling with filaments of the matrix yarn which intermingling provides sufficient coherency between the yarns but generally is not sufficient to shown up as much blending of colors in the heather-dyed combined yarn.

The combined yarn is direct tufted into a conventional polypropylene spun-bonded carpet backing in a level loop construction using 1/10 inch (0.254 cm.) gauge, 3/16 inch (0.48 cm.) pile height at a carpet weight of 24 oz./yd.$^2$ (828 g/m$^2$). The carpeting is dyed in a conventional manner in a beck using a mixture of dyes which give a deep brown, a light yellow and an orange color to the cationic, light acid and deep acid yarn components respectively. The carpet pile loops show individual color-points of the individual colors randomly distributed with little blending together of the three colors. There is little carry-over of a color or color-effect from one loop to adjacent loops. The dyed carpet appears free of objectionable streaks and directionality.

A carpet of this example is wear-tested in a hallway for 40,000 cycles (steps) along with a comparable control carpet made from heather yarn prepared according to the process of U.S. Pat. No. 4,059,873. After the testing, the carpet samples are rated by a panel of judges on a scale of 1 to 5, with 5 being the best (e.g. like original). The results given in the following table show the test carpet of this invention to be superior in every rating category:

| Rated For: | Test | Control |
|---|---|---|
| Texture Retention | 3.5 | 2.7 |
| Matting | 4.0 | 2.7 |
| Soiling | 3.0 | 2.3 |
| Fuzzing | 4.5 | 3.1 |
| Pilling | 5.0 | 4.7 |

EXAMPLE II

This example is of a three component BCF 66-nylon heather yarn of the invention containing two color-point yarns (cationic and light acid dyeable) and one matrix yarn (deep acid dyeable) all three of which have been hot fluid jet-bulked and are of equal yarn denier and filament count; that is 760 denier and 60 filaments (11 dpf). The filaments have a trilobal cross-section with a modification ratio of 2.3 and contain titanium dioxide pigment to give a semi-dull luster.

The apparatus and process conditions are substantially the same as given for Example I except for a feed roll speed of 612 ypm (560 m/min), disentangling tension of 1.05 gpd, water application 1.0 gal/hr. (3.78 l./hr.), take-up roll speed 502 ypm (459 m./min.), 22% overfeed and a winding tension of 150 gm. Also, the intermingling jet device for combining the matrix and color point yarns has a cylindrical yarn passageway 0.204 inches in diameter (0.518 cm.) and 1.0 inch (2.54 cm.) long. The yarn passageway is perpendicularly intersected at its center by a rectangular fluid passage 0.195 inch (0.495 cm.) by 0.107 inches (0.272 cm.) and having its long dimension parallel to the axis of the yarn passage. Although this jet uses more air than the one in Example I, it gives the desired degree of entanglement more easily and consistently. The gate is set to block 59% of the yarn passageway entrance. Upon entering the intermingling zone the color-point yarns have periodic entanglement to give pull-apart values of 1.35 in. (3.4 cm.) and 1.55 in. (3.94 cm.) for the cationic and light dyeing yarns respectively; at that point the coherency factor for the matrix yarn is less than 6. Upon careful removal from the combined yarn the color-point yarns have pull-apart values of 1.32 in. (3.35 cm.) and 1.28 in. (3.25 cm.) respectively.

The combined yarn is direct tufted into a level loop carpet at 18 oz./yd.$^2$ (660 gm./m$^2$) and a 3/16 in. (0.47 cm.) pile height. The carpet is piece dyed in a dyebath under conventional conditions containing a mixture of acid and cationic dyestuffs to give heather coloration.

The yarn and carpet have substantially the same novel structural and colorational attributes as the yarn and carpet of the invention described in Example I.

This example is repeated with substantially the same results using three differentially-dyeable yarns which are each of 1225 denier, 19 dpf, tetralobal 4-void hollow filaments of bright 66-nylon polymer.

EXAMPLE III

This example demonstrates the invention with a combined 66-nylon yarn prepared from only one deep-acid dyeable BCF color-point yarn and one cationically dyeable BCF matrix yarn of substantially equal yarn deniers (1225) but different filament counts (64 and 80 filaments respectively).

The apparatus and process conditions are the same as described in Example I except that the feed roll speed is 1119 YPM (1023 mpm) coner roll speed is 966 YPM (883 mpm) and the overfeed is 15.7 percent. The tension used for disentanglement is 1.05 gpd and the winding tension is 150 grams.

The combined yarn obtained has the novel filament entanglement and intermingling characteristics of the invention between the two component yarns as described in Example I.

A level loop pile carpet is made from the resulting yarn and dyed to make the color-point yarn dark brown and the matrix yarn orange. The carpet shows points of the individual colors with frequent constricted (nodal) dark brown points, with little blending or orange and brown colors and with no apparent streakiness or directionality.

For comparison, a comparable carpet is made from a heather yarn of the same feed yarns but processed as claimed in U.S. Pat. No. 4,059,873. A majority of the loops in this carpet show a blending of filaments of the two colors with frequent carry-over of the same color or color-effect to adjacent loops. The brown color seldom appears as a substantial clear spot of pure dark brown color because of a generally higher degree of filament intermingling between the two component yarns.

EXAMPLE IV

This example is of a three-component tri-dyeable yarn of the invention wherein two color-point yarns are overfed to the intermingling zone at a higher percent overfeed than the matrix yarn. All three yarns are BCF yarns of 66-nylon sold by E. I. du Pont de Nemours and Company, Wilmington, Del. for use in carpets. One of the color-point yarns is cationically dyeable (1225 denier Type 854) and the other is a deep-acid dyeable yarn (1245 denier Type 857A). The matrix yarn has light-acid dyeability (1225 denier Type 855).

The apparatus is substantially as shown in FIG. 1 except that stepped snubbing rolls and feed rolls are used; the color-point yarns being fed by the larger diameter portion to provide the greater overfeed as known in the art. The feed roll speed for the color-point ends is 855 ypm (782 mpm) and 700 ypm (640 mpm) for the matrix yarn. The yarns are under a tension of 1.1 gpd as they are passed over the snubbing pins in the filament disentangling zone prior to the intermingling zone. Water is applied to the yarns at a flow rate of 1.5 gal/hr (5.68 l./hr). The entangling jet (for the color-point ends) and the intermingling jet are operated substantially as described in Example I. The combined yarn is withdrawn at a rate controlled by the coner roll speed operating at 627 ypm (573 mpm). This provides a percent overfeed for the color-point yarns of 36% and 12% for the matrix yarn. The difference in overfeeds therefore being 24%; thus providing a combined yarn wherein the color-point yarns are substantially 24% longer than the filaments of the matrix yarn.

The combined 4000 denier yarn is a heather-dyeable BCF carpet yarn having a rough texture in which the color-point ends buckle and form bundle loops randomly over the combined yarn surface.

EXAMPLE V

This example substantially repeats Example IV except that the matrix first yarn is overfed more than the two color-point second yarns. The process conditions remains the same except the tension for disentanglement is 1.15 gpd, and the coner roll speed is 609 ypm (557 mpm) resulting in an overfeed of 15% for the color-point yarns and 40% for the matrix first yarn, a differential overfeed of 25%. The combined yarn has a total denier of about 4,000. After cross-dyeing in a conventional manner the resulting highly entangled yarn shows sections of pronounced color in the entangled color-point core ends under a covering of looped and entangled lighter colored filaments of the matrix yarn.

Having thus described my invention, what I claim is:

1. A heather-dyeable or heather-dyed synthetic combined yarn comprised of a first yarn in the form of a relatively loose matrix of crimped filaments which are randomly intermingled with portions of at least one second bulked yarn which is differentially-dyeable or differentially-dyed with respect to said first yarn and which contains frequent periodic relatively compact nodal regions of high filament entanglement across the entire filament bundle of the second yarn which nodal regions are substantially free from intermingling with filaments of said first yarn, said nodal regions being separated from one another along the second yarn by bulkier relatively open regions of the same filaments randomly intermingled with filaments of said first yarn to provide a coherent combined yarn.

2. A yarn of claim 1 wherein the overall average distance between the nodal regions in each second yarn is within the range of from about 0.5 to 2.5 inches.

3. A yarn of claim 2 wherein the filaments of either one of said first and second yarns are from 15 to 45% longer than the filaments of the other of said first and second yarns.

4. A yarn of claim 2 or 3 consisting essentially of two color-point second yarns and one first yarn all of which are differentially-dyeable or differentially-dyed with respect to each other.

5. A yarn of claim 2 or 3 wherein the first yarn comprises at least about ⅓ of the total combined yarn denier.

6. A yarn of claim 5 in which each of said first and second yarns is comprised of 66-nylon.

7. A tufted carpet comprised of a yarn of claim 1, 2, 3 or 6.

8. An improved process for making a heather-dyeable or heather-dyed yarn by feeding a plurality of substantially twist-free, differentially-dyeable or differentially-dyed, bulked continuous filament yarns under forwarding tension and in a contiguous relationship into a jet intermingling zone, randomly jet intermingling the filaments of said yarns from yarn to yarn within said zone withdrawing a coherent combined yarn from said zone at a rate which is 4 to 30% less than the feed rates of the yarns into said zone, with one yarn of said plurality being a first yarn which is substantially free of filament entanglement, wherein the improvement comprises feeding as another yarn of said plurality a second yarn to provide color-points which is differentially-dyeable or differentially-dyed with respect to said first yarn and which has periodic filament entanglement consisting essentially of frequent short relatively compact nodal regions of high entanglement across the entire filament bundle separated along the second yarn by bulkier regions of the same filaments which bulky regions are relatively free of entanglement so that yarn-to-yarn filament intermingling in the combined yarn is substantially prevented within said nodal regions, with the proviso that when the feed rates of said first and second yarns are not equal, overfeed for the faster of the two can be up to 45% higher than the overfeed for the slower of the two.

9. A process of claim 8 wherein the average distance between said compact nodal regions in each second yarn is within the range of from about 0.5 to 2.5 inches.

10. A process of claim 9 wherein the feed rates of said first and second yarns are equal.

11. A process of claim 9 wherein the feed rates of said first and second yarns are not equal.

12. A process of claim 11 wherein the percent overfeed for the faster of said first and second yarns less the percent overfeed for the slower of the two is within the range of from 15 to 45%.

13. A process of claim 12 wherein the differences between the two overfeeds is within the range of from 20 to 30%.

14. A process of claim 8, 9, 10 or 11 including the step of subjecting said plurality of yarns to a tension of from 0.5 to 1.5 grams per denier to straighten the crimp of the filaments within each of said yarns and to disentangle and parallelize their filaments just prior to feeding said yarns into said jet intermingling zone.

* * * * *